US006184632B1

(12) United States Patent
Kamata et al.

(10) Patent No.: US 6,184,632 B1
(45) **Date of Patent: *Feb. 6, 2001**

(54) LIGHTING APPARATUS INCLUDING CIRCUIT TO DETECT AN ELECTRICAL CHARACTERISTIC OF A COMPONENT OF A LAMP MOUNTED IN THE APPARATUS

(75) Inventors: Masahiko Kamata; Kazutoshi Mita; Kazuo Takita, all of Kanagawa-ken (JP)

(73) Assignee: Toshiba Lighting & Technology Corporation, Tokyo (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/099,346

(22) Filed: Jun. 18, 1998

(30) Foreign Application Priority Data

Jun. 19, 1997 (JP) ..... P09-162325

(51) Int. Cl.[7] ..... H05B 37/02

(52) U.S. Cl. ..... 315/225; 315/224; 315/307; 315/308

(58) Field of Search ..... 315/224, 360, 315/DIG. 5, 307, 276, 274, 291, 207, 208, 308, 225, 209 R, 247

(56) References Cited

U.S. PATENT DOCUMENTS

| | | | | |
|---|---|---|---|---|
| 4,322,658 | * | 3/1982 | Minarczyk | 315/47 |
| 4,377,772 | * | 3/1983 | Tsuchihashi et al. | 315/46 |
| 4,442,382 | | 4/1984 | Fleck | 315/287 |
| 4,520,294 | * | 5/1985 | Iida et al. | 315/50 |
| 5,023,516 | * | 6/1991 | Ito et al. | 315/224 |
| 5,103,143 | * | 4/1992 | Daub | 315/308 |
| 5,442,257 | | 8/1995 | Mitsumoto | 315/129 |
| 5,523,656 | * | 6/1996 | Luursema | 315/308 |
| 5,583,399 | * | 12/1996 | Rudolph | 315/225 |
| 5,589,740 | * | 12/1996 | Rudolph et al. | 315/225 |
| 5,663,613 | * | 9/1997 | Yamashita et al. | 315/308 |
| 5,705,897 | | 1/1998 | Hanazaki et al. | 315/307 |
| 5,773,937 | * | 6/1998 | Miyazaki et al. | 315/209 R |
| 5,869,935 | * | 2/1999 | Sodhi | 315/246 |

FOREIGN PATENT DOCUMENTS

| | | |
|---|---|---|
| 091728 | 10/1983 | (EP) . |
| 2072958 | 10/1981 | (GB) . |
| 2132834 | 7/1984 | (GB) . |
| 2318932 | 5/1998 | (GB) . |
| 8-31589 | 2/1996 | (JP) . |

* cited by examiner

*Primary Examiner*—Don Wong
*Assistant Examiner*—Wilson Lee
(74) *Attorney, Agent, or Firm*—Pillsbury Madison & Sutro LLP

(57) ABSTRACT

A lighting apparatus of the present invention includes a discharge lamp incorporating a detecting element having a predetermined electrical characteristic, a detector circuit to discriminate the electrical characteristic of the detecting element and a lighting circuit to light the discharge lamp according to the output from the detector circuit. According to the lighting apparatus of the present invention, it is possible to detect whether a discharge lamp mounted in the socket is an adapted lamp without necessity for lighting the discharge lamp.

12 Claims, 7 Drawing Sheets

LIGHTING APPARATUS INCLUDING CIRCUIT TO DETECT AN ELECTRICAL CHARACTERISTIC OF A COMPONENT OF A LAMP MOUNTED IN THE APPARATUS

BACKGROUND OF THE INVENTION

1. Field of the Invention

The present invention relates to a lighting apparatus for lighting a discharge lamp.

2. Description of the Related Art

The technique to detect wattage of a discharge lamp by detecting an electrical characteristic of the discharge lamp when it is lighted in order to prevent the erroneous mounting of a discharge lamp having a different rated lamp voltage in a socket has been disclosed in Japanese Published Unexamined Patent Application JP-A No, 7-106088.

This type of lamp base has become commonly used for different kinds of lamps in recent years because different kinds of lamps may be erroneously mounted in different kinds of lamp sockets.

However, in the conventional technology disclosed in the Published Unexamined Patent Application JP-A No. 7-106088, there is a problem that even the same type lamps have different wattage ratings, it is not possible to prevent erroneous mounting of these high pressure discharge lamps and incandescent lamps.

Further, in the above-mentioned conventional technique, in order to detect that a lamp mounted in a socket is properly adapted from the viewpoint of its type and rated power, the mounted lamp must be lighted. Therefore, if a high pressure discharge lamp that has a lower rated lamp power is lighted in a high pressure discharge lamp lighting apparatus, this lamp receives an overcurrent and may possibly burst.

SUMMARY OF THE INVENTION

It is an object of the present invention to provide a lighting apparatus capable of detecting whether a lamp mounted in a socket is a adapted lamp without necessity of lighting it The lighting apparatus of the present invention is composed of a discharge lamp incorporating a detecting element having a predetermined electrical characteristic, a detector circuit for discriminating the electrical characteristic of the detecting element and a lighting circuit for lighting the discharge lamp according to the output from the detector circuit.

DETAILED DESCRIPTION OF THE PREFERRED EMBODIMENTS

Hereinafter, several embodiments of the lighting apparatus of the present invention will be described with reference to the attached drawings.

Figure 1:
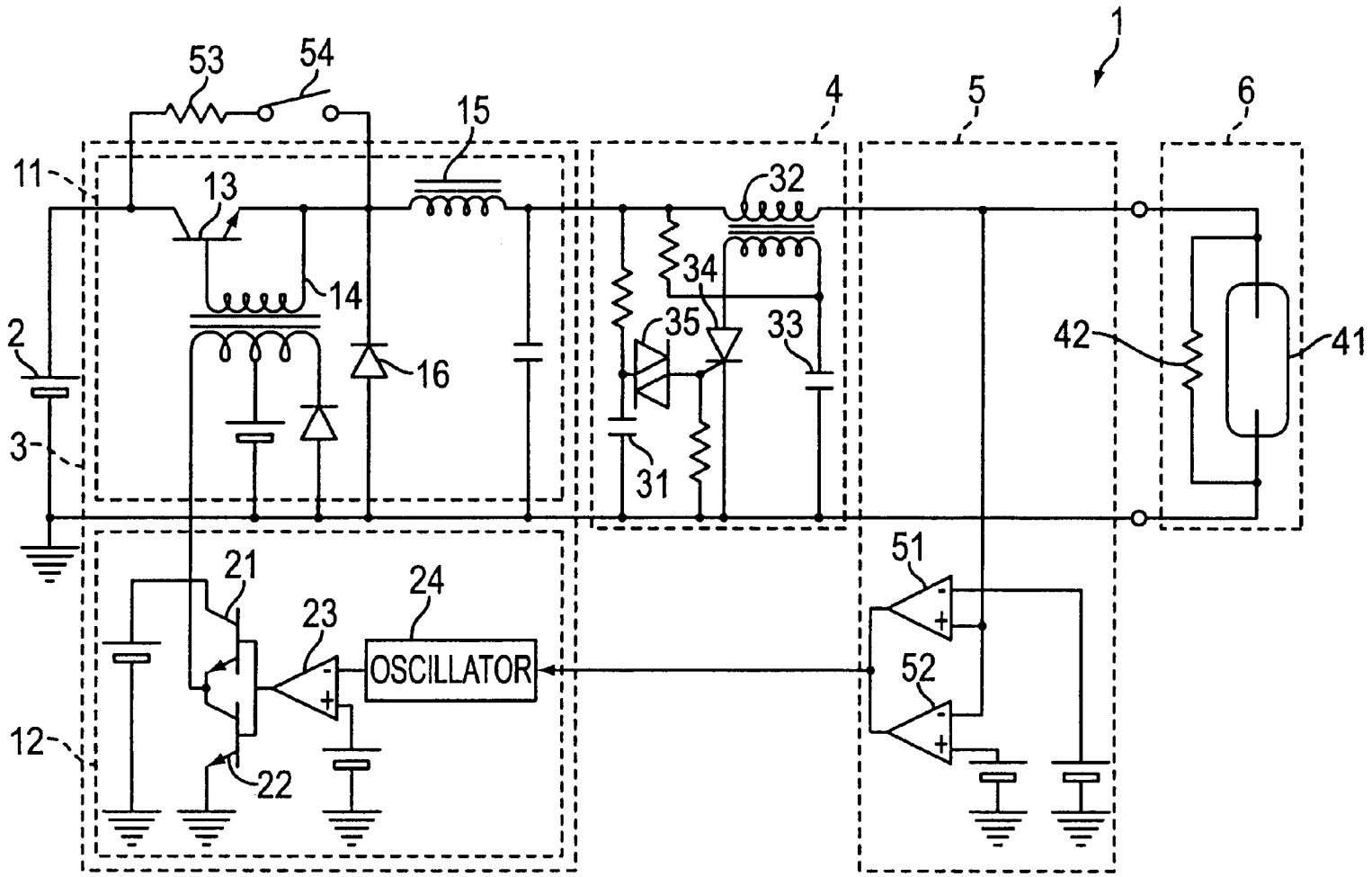
FIG. 1 is a circuit diagram showing a first embodiment of a lighting apparatus of the present invention.

FIG. 1 is a circuit diagram of a lighting apparatus showing a first embodiment of the present invention and is for direct current.

In the lighting apparatus, a lighting circuit 3, a starting circuit 4, a lamp mounting detector circuit 5 and a high pressure discharge lamp 6 are connected to the power line of a DC power source 2 as shown in FIG. 1.

The lighting circuit 3 comprises a driving circuit 11 which drives the high pressure discharge lamp 6 to light and a controlling circuit 12 which controls the driving circuit 11.

The driving circuit 11 comprises a switching element 13, a transformer 14 of which secondary side winding is connected to the base side of the switching element 13*f* a choke coil 15, a diode 16, etc. When square wave is input to the primary side winding of the transformer 14, the switching element 13 is turned. ON/OFF to drive the high pressure discharge lamp 6 to light.

The controlling circuit 12 comprises switching elements 21 and 22 to turn ON/OFF electric power supplied to the primary side winding of the transformer 14, a comparator 23 of which an output side is connected to the gate sides of the switching elements 21 and 22, an oscillator 24 of which an output side is connected to the inversion input terminal of the comparator 23, etc. At triangle wave pulse which is output from the oscillator 24 is compared with a prescribed reference voltage in the comparator 23 and the output corresponding to the result of this comparison is output to the switching elements 21 and 22 from the comparator 23. By the turn-on/off of the switching elements 21 and 22, the output corresponding to the duty ratio of square wave that is applied to the transformer 14 is supplied from the driving circuit 11 to the high pressure discharge lamp 6.

The starting circuit 4 comprises a capacitor 31 connected between the power lines, a pulse transformer 32, a capacitor 33 of which one side is connected to the minus side of the power line and the other side is connected to the primary side winding of the pulse transformer 32, a thyristor 34 of which anode side is connected to the primary side winding of the pulse transformer 32 and the cathode side is connected to the minus side of the power line, a diode AC switch 35 connected to the charging side of the capacitor 31 and the gate side of the thyristor 34, etc. When electric energy more than the fixed level is accumulated in the capacitor 31, the diode AC switch 35 triggers the thyristor 34 and the charge current flows from the capacitor 33 to the primary side winding of the pulse transformer 32 repetitively. By repeating this operation, starting pulses are applied to the high pressure discharge lamp 6 from the secondary side winding of the pulse transformer 32.

Figure 2:
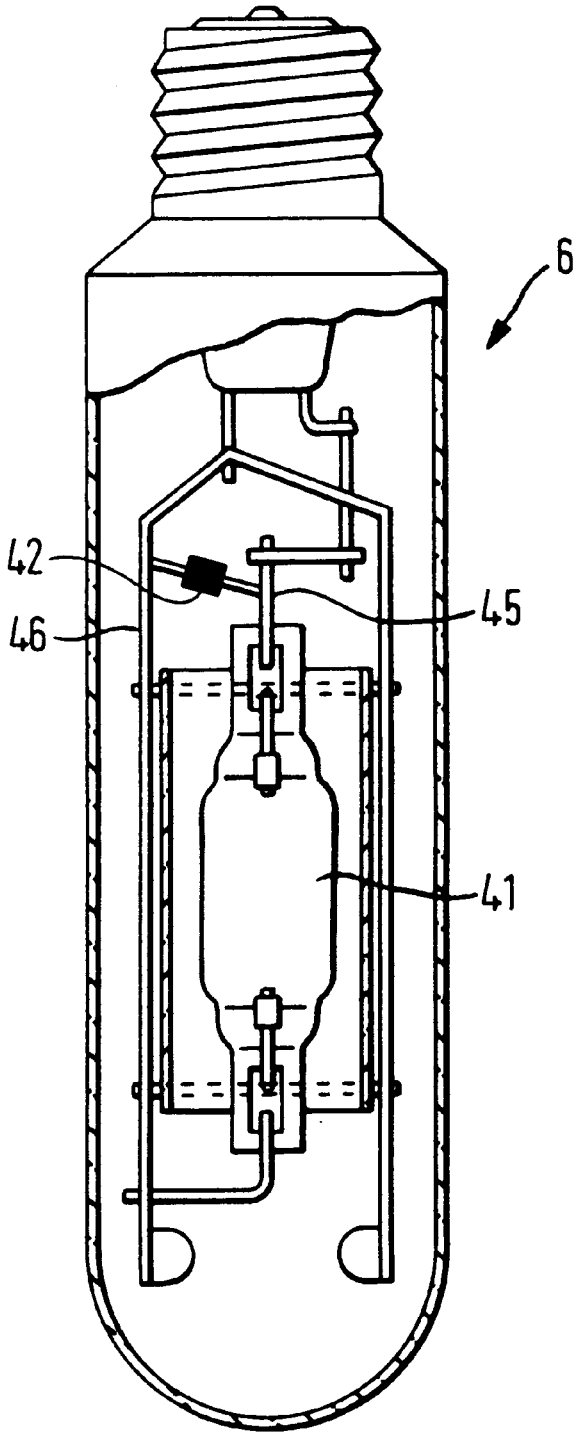
FIG. 2 is a plan view showing a high pressure discharge lamp that is a adapted lamp in the lighting apparatus shown in FIG. 1.
Figure 3:
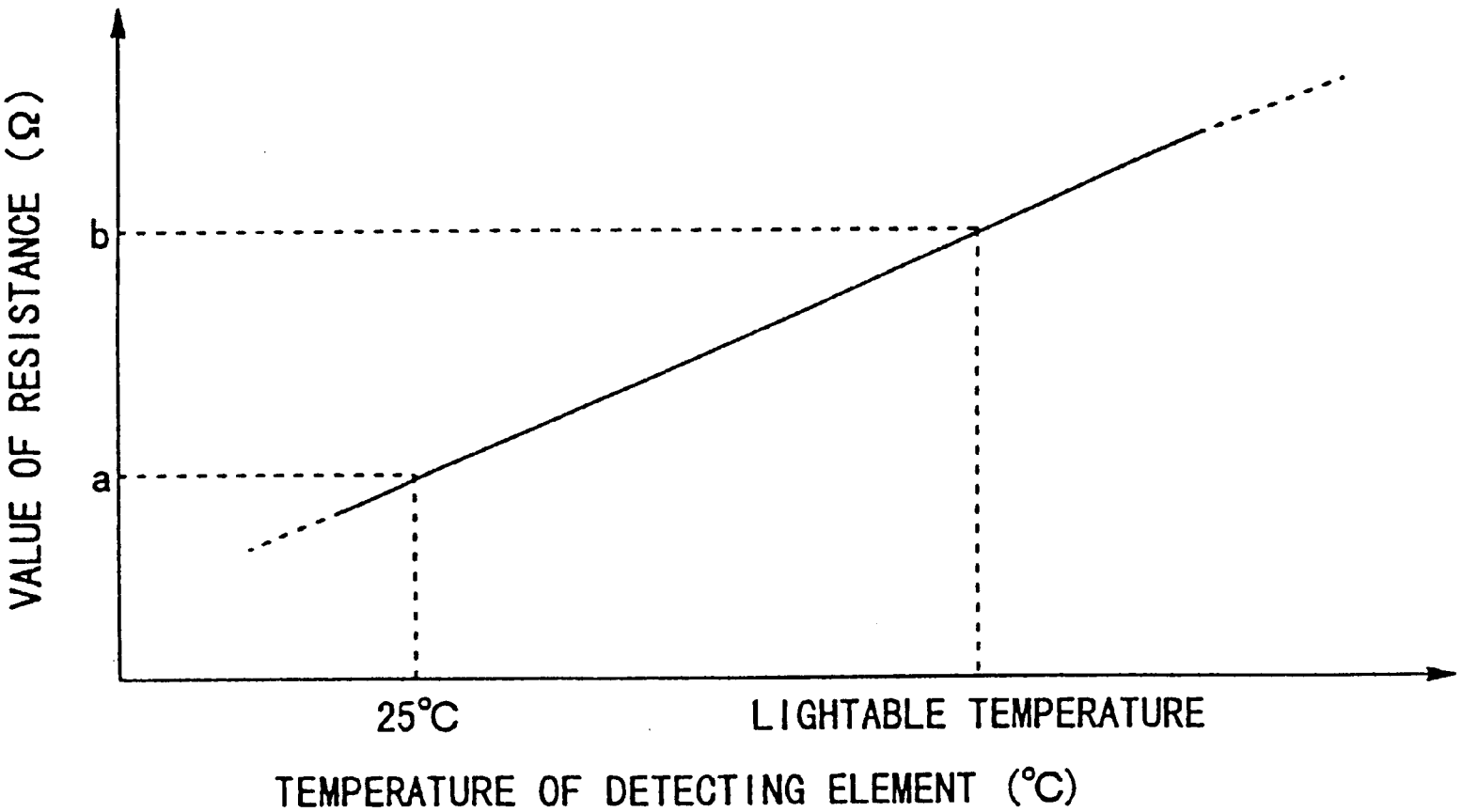
FIG. 3 is a graph for explaining the action of the lighting apparatus shown in FIG. 1.

The discharge lamp 6 is, for instances a metal halide lamp, and an arc tube 41 and a detecting element 42 are connected in parallel. More definitely, the high pressure discharge lamp 6 comprises an outer bulb 43 and the arc tube 41, which is suspended in the outer bulb 43. The outer bulb 43 has a screw base 44 for coupling to a socket (not shown) at its one end. A detecting element 42 is incorporated in the outer bulb 43 and is connected between wires 45 and 46 which supply electric power to the arc tube 41 as shown in FIG. 2. The detecting element 42 is a resistance for divided voltage detecting in this embodiment. The detecting element 42 has a temperature coefficient of resistance more than 500 ppm/° .C Further, a resistance value of the detecting element 42 is larger than an equivalent resistance value of the arc tube 41 when it is lighted.

The lamp mounting detector circuit 5 is equipped with comparators 51 and 52, and the non-inversion input terminal of the comparator 51 and the inversion input terminal of the comparator 52 are connected to the plus side of the power supply line to the high pressure discharge lamp 6. The inversion input terminal of the comparator 51. and the non-inversion input terminal of the comparator 52 are connected to reference voltage sources, respectively. That is, the voltage at the plus side of the power supply line is compared with the reference voltages of these reference voltage sources. The output terminals of the comparators 51 and 52 are connected with each other and the combined output voltage of both comparators is input to the oscillator 24.

A resistor 53 used for detecting a divided voltage in this embodiment divided voltage. The resistor 53 is connected together with a switch 54 in series between the emitter and the collector of the switching element 13 and is able to apply current to the power line bypassing the switching element 13.

Next, the operation of the lighting apparatus 1 will be described.

When the switch 54 is closed, the current flows to the high pressure discharge lamp 6 bypassing the switching element 13. At this time, as the starting circuit 4 and the lighting circuit 3 are not in operation, the arc tube 41 is not ON and DC current flows to the detecting elements 53 and 42 which are connected with each other in series. As a result, a divided voltage corresponding to a size of resistance value of the high pressure discharge lamp 6, that is, the detecting element 42 is applied to the comparators 51 and 52. Both of the comparators 51 and 52 output minus voltages only when the divided is within the range of fixed numerical values corresponding to reference voltages input to these comparators, respectively.

When a resistance value of the high pressure discharge lamp 6, that is, a resistance value of the detecting element 42 is in a range of fixed numerical values, a lamp mounted in the socket of the lighting apparatus 1 is judged to be a lamp adaptable to the lighting apparatus 1. The combined voltage of minus voltages output from the comparators 51 and 52 at that time is usable as the starting signal to drive the lighting apparatus J.

When describing definitely, if a metal halide lamp for 250 watt is adaptable to the lighting apparatus 1, a metal halide lamp outputs the driving start signal as an adapted lamp if the detecting element 42 of which resistance is in the range of fixed numerical values is connected to a 250 watt metal halide lamp. A resistance value in this range of fixed numerical values is, for instance, 200 kΩ. On the contrary, if the lamp mounted in the lighting apparatus 1 is a metal halide lamp of other rated lamp power (70 watt, 150 watt, etc.) or another kind of lamp, for instance, an incandescent lamp, as this mounted lamp has a different resistance value (as there is a filament in an incandescent lamp, current flows but a resistance value of this filament is small), it can be detected that the lamp mounted in the socket is the wrong type lamp without lighting the lamp.

Further, by detecting whether a resistance value of the detecting element 42 is within the range of fixed numerical values, it is possible to judge if a mounted lamp, after being turned OFF is in the state ready to be lighted again. That is, the higher the lamp temperature, the higher a resistance of the detecting element 42 becomes. Thus, it may not be possible to light the lamp again even when a starting pulse is given. Therefore, to light a lamp again, it is possible to prevent the supply of starting pulses until the lamp temperature drops to a lower level by stopping the starting circuit 4.

In this case, it is desirable to make the upper limit value of resistance in the range of fixed numerical values below a value b that is considered to be the upper limit value able to light the high pressure discharge lamp 6 and above a resistance value at the normal temperature (about 25° C.).

Further, as a temperature coefficient of resistance is above 500 ppm/° C., it is preferred that the inclination of resistance value to the lamp temperature change can be made sufficiently large.

As described above, when a lamp mounted in the socket is judged to be a lamp adaptable to the lighting apparatus 1 and the lighting apparatus drive starting signal is output to the oscillator 24 of the controlling circuit 12, the controlling circuit 12 drives the driving circuit 11. When the driving circuit 11 is driven, the starting circuit 4 is also driven and a starting pulse is given to the high pressure discharge lamp 6, which is an adapted lamp, and the high pressure discharge lamp lights.

Further, as a resistance value of the detecting element 42 is set at larger than an equivalent resistance value when the arc tube 41 is turned on, the power loss when electric power is applied to the detecting element 42 can be made relatively small.

Furthermore, as the detecting element 42 is connected to the wires 45 and 46 as described above, it contributes to improve the mounting strength of the arc tube 41.

Next, a second embodiment of the present invention will be described.

Figure 4:
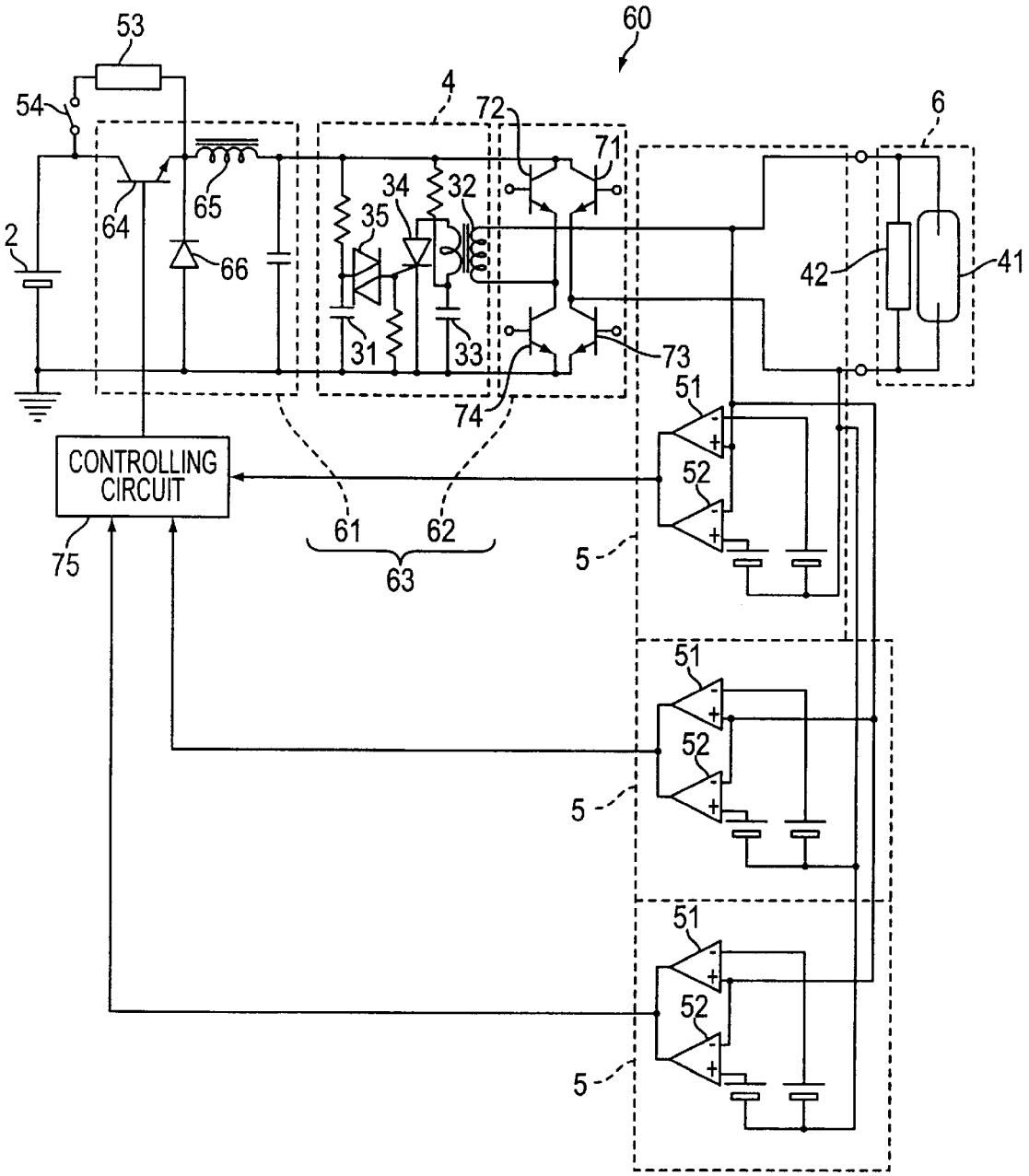
FIG. 4 is a circuit diagram showing a second embodiment in the lighting apparatus of the present invention.

FIG. 4 is a circuit diagram of a lighting apparatus 60 showing the second embodiment of the present invention and is for alternate current.

In FIG. 4, the circuit elements assigned with the same reference numerals as in FIGS. 1 and 2 are the same as those in the first embodiment of the present invention and therefore, the detailed explanations thereof will be omitted.

As shown in FIG. 4, the lighting apparatus 60 is equipped with a lighting circuit 63 comprising a DC—DC converter 61 and an inverter circuit 62.

The DC—DC converter 61 is composed of a switching element 64, a choke coil 65, a diode 66, etc. and a signal voltage is applied to the gate of the switching element 64 from a controlling circuit 75.

The inverter circuit 62 is a full-bridge circuit comprising four switching elements 71, 72, 73 and 74. The switching elements 71, 72, 73 and 74 are turned on/off to drive the high pressure discharge lamp 6 by alternate current.

A controlling circuit 75 turns on/off the switching element 64 by outputting signals having different duty ratios.

The lighting apparatus 60 is provided with a plurality of stages of the lamp mounting detector circuit 5 (3 stages in this embodiment), and in each of the lamp mounting detector circuits 5, various reference voltages are set for the comparators 51 and 52.

Next, the operation of the lighting apparatus 60 will be described.

As the lighting apparatus 60 is provided with a plurality of stages of the lamp mounting detector circuits 5 (3 stages in this embodiment) and in each of the lamp mounting detector circuits 5, various reference voltages are set for the comparators 51 and 52. Thus, it is possible to set divided voltage in various ranges of different fixed numerical values according to size of resistance of the high pressure discharge lamp 6, that is, the detecting element 42, that can be detected in each of the lamp mounting detector circuits 5.

Then, each of the different fixed numerical value ranges is brought to correspond to a plurality of kinds of rated lamp power (for instance, 70, 150 and 250 watts) of the high pressure discharge lamp 6. It is therefore possible to judge whether the type of the lamp is proper or whether its rated power is proper according to whether a signal is output from lamp mounting detector circuit 5.

When no signal is input to the controlling circuit 75 from any lamp mounting detector circuit 5, the switching element 64 is not turned on/off. Therefore, as the lighting circuit 63 is not driven, a lamp mounted in the socket is judged to be not adaptable. Accordingly, that lamp is an adapted lamp (an incandescent lamp, etc.) and does not light.

When a signal is input to the controlling circuit 75 from one of the lamp mounting detector circuits 5, the ON time ratio of the switching element 64 is changed according to the lamp mounting detector circuit 5 from which that signal is output. According to this change in ON time ratio, the rated lamp power of a mounted lamp that is an adapted lamp is judged and the output corresponding to that rated lamp power is output from the DC—DC converter 61.

Next, a third embodiment of the present invention will be described.

Figure 5:
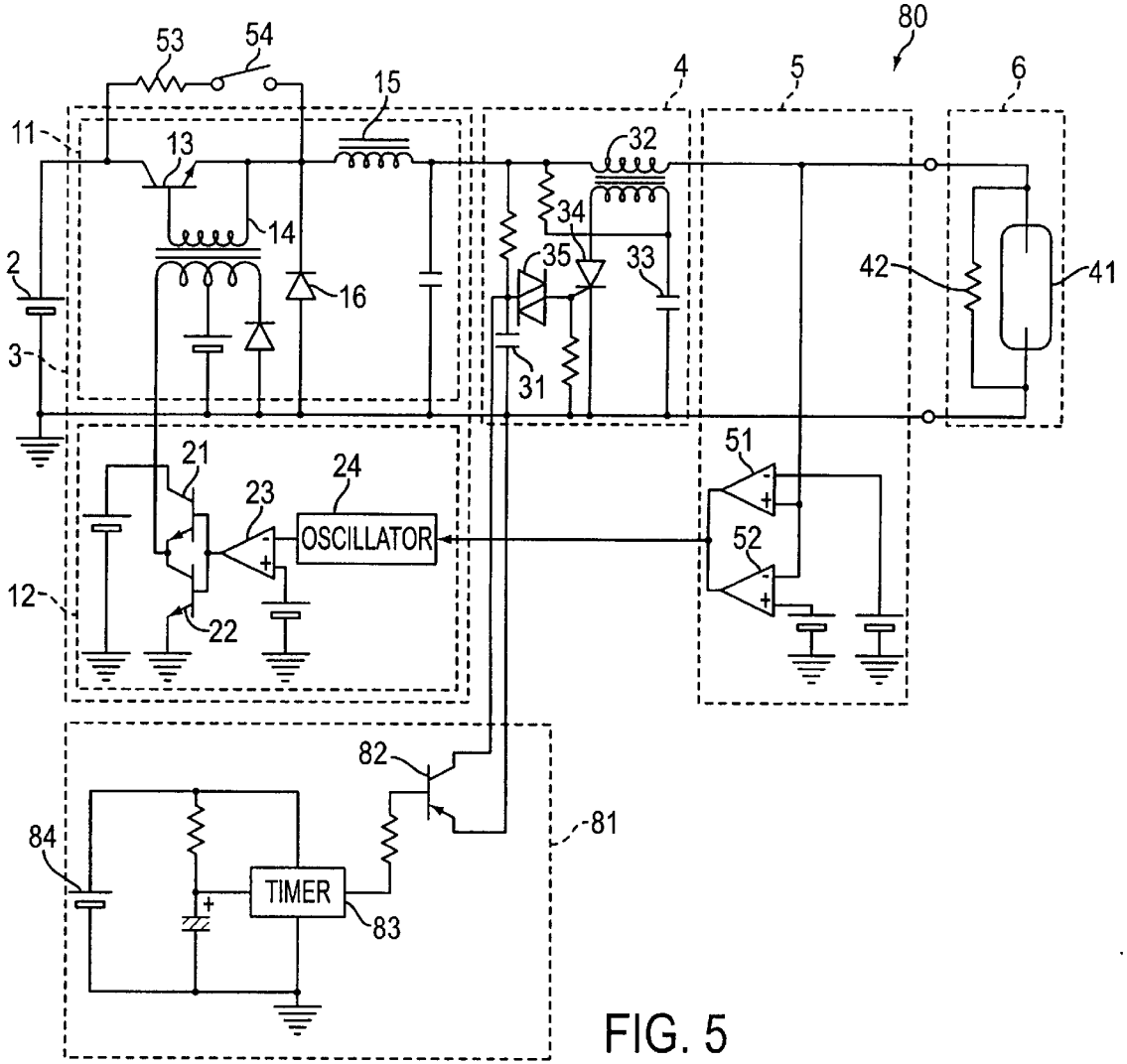
FIG. 5 is a circuit diagram showing a third embodiment in the lighting apparatus of the present invention.

FIG. 5 is a circuit diagram of a lighting apparatus 80 showing the third embodiment of the present invention. In this FIG. 5, the circuit elements assigned with the same reference numerals as those shown in FIGS. 1 and 2 are the same as those in the first embodiment of the present invention and therefore, the detailed explanations thereof will be omitted.

The lighting apparatus 80 is the lighting apparatus 1 added with a pulse generation deactive circuit 81.

The pulse generation deactive circuit 81 is composed of a switching element 82 comprising the capacitor 31 with an emitter and a collector connected to its two sides, a timer 83 connected to the gate side of the switching element 82 for turn on/off the switching element 82, a DC power source 84, etc. The DC power source 84 supplies the electric power to the timer 83 to drive it when the starting circuit 4 is operated.

Next, the operation of the lighting apparatus 80 will be described.

When the switch 54 is closed, a lamp mounted in the socket is judged as to whether it is an adapted lamp, the first embodiment. When the lamp is judged to be an adapted, the starting circuit 4 generates the starting pulse and tries to start the lamp.

The timer 83 starts the counting for a preset fixed amount of time. When this fixed time is over, the voltage is output from the timer 83 to the gate side of the switching element 82 and the switching element 82 is turned on. When the switching element 82 is turned on, the circuit between the switching element 82 and the capacitor 31 is short-circuited and the charging of the capacitor 31 is interrupted and therefore, the starting circuit 4 stops the subsequent operation.

To turn on the high pressure discharge lamp 6 when it is not sufficiently cooled down after it was turned off, the lamp mounting detector circuit 5 may not be able to judge a mounted lamp to be an adapted lamp due to the temperature characteristic of the detecting element 42 in some cases. When a mounted lamp was sufficiently cooled down and the lamp mounting detector circuit 5 judges it to be an adapted lamp, the starting circuit 4 starts to generate the starting pulse. Then, interlocking with the start of the starting circuit 4, the timer 83 is also energized and begins the counting for a fixed time. Even when the high pressure discharge lamp 6 is pulled out of the socket or becomes defective during this period, it is tried to start the lamp for the fixed time when the timer 83 is counting and then, the starting circuit 4 is stopped. Therefore, the useless pulse generation is prevented and the dielectric breakdown of the base of a lamp mounted in the socket and adverse effects to other electric/electronic equipment will never be caused.

Then, a fourth embodiment of the present invention will be described.

Figure 6:
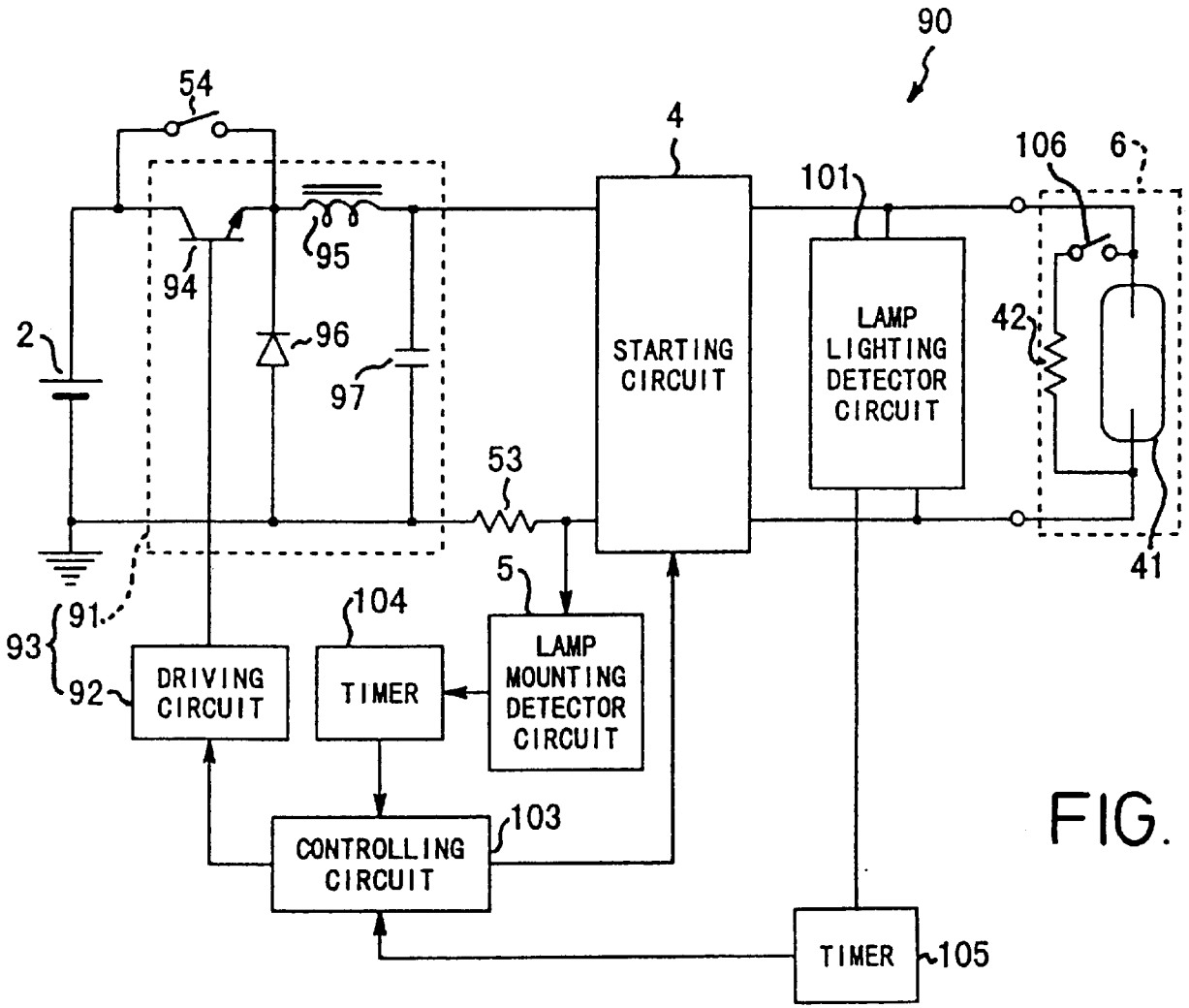
FIG. 6 is a circuit diagram showing a fourth embodiment in the lighting apparatus of the present invention.

FIG. 6 is a circuit diagram of a lighting apparatus 90 showing the fourth embodiment of the present invention. In FIG. 6, the circuit elements assigned with the same reference numerals as those shown in FIGS. 1 and 2 are the same as those in the first embodiment of the present invention and therefore, the detailed explanations thereof will be omitted.

The lighting apparatus 90 is equipped with a lighting circuit 93 comprising a DC—DC converter 91 and a driving circuit 92. The DC—DC converter 91 is composed of a switching element 94, a choke coil 95, a diode 96, a smoothing capacitor 97, etc.

The driving circuit 92 is connected to the gate of the switching element 94 and turns the switching element 94 on/off at a fixed ON time ratio.

The resistor 53 is connected to the output line at the minus side of the DC—DC converter 91 and the switch 54 is connected so as to by-pass the switching element 94 without passing through the resistor 53.

A lamp lighting detector circuit 101 is connected in parallel with a lamp mounted in the socket and detects the lighting of the mounted lamp according to fluctuation of divided voltage of the mounted lamp.

A timer 105 starts the counting for a fixed time and when it was not lighted until the counting time was over, the timer 105 outputs a signal to a controlling circuit 103. Upon receipt of this signal, the controlling timer 103 outputs a drive stopping signal to the driving circuit 92 and the starting circuit 4.

The lamp mounting detector circuit 5 starts the counting for a fixed time by a timer 104 when judging that a lamp mounted in the socket is an adapted lamp. When this counting is completed, the controlling circuit 103 sends a signal to the driving circuit 92 which in turn drives the DC—DC converter 91.

Figure 7:
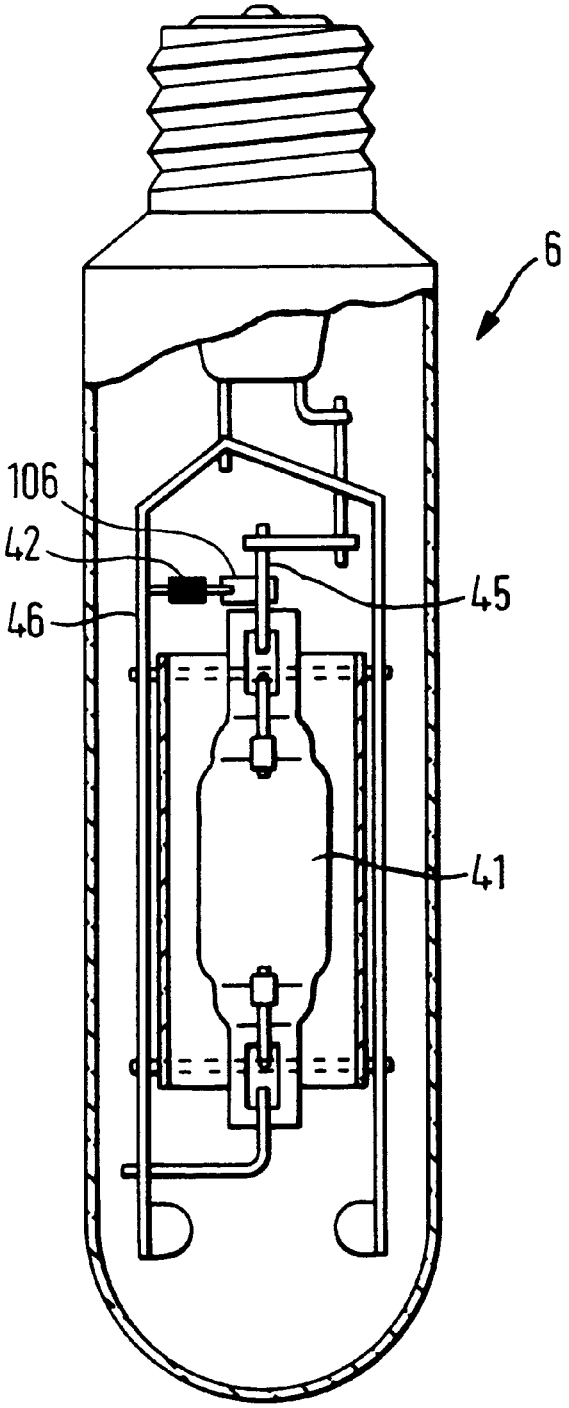
FIG. 7 is a plan view showing a high pressure discharge lamp that is a adapted lamp in the lighting apparatus shown in FIG. 6.

In the high pressure discharge lamp 6, a thermally-actuated element 106 such as a bimetal switch is connected to turn off the power supplied to the detecting element 42 according to temperature rise. The thermally-actuated element 106 is arranged near the arc tube 41 so as to be able to perceive heat of the arc tube 41 sufficiently as shown in FIG. 7.

Next, the operation of the lighting apparatus 90 will be described.

When the high pressure discharge lamp 6 which is an adapted lamp is mounted in the state where the switch 54 is closed and no lamp is mounted in the lighting apparatus 90, the lamp mounting detector circuit 5 judges the mounted lamp to be an adapted lamp according to the divided voltage of the detecting element 42. According to this judgment, the controlling circuit 103 outputs a control signal to drive the lighting circuit 93 and in addition, the starting circuit 4 is driven to light the high pressure discharge lamp 6. Therefore, it is possible to automatically light a lamp only when an adapted lamp is mounted.

In this case, the lamp mounting detector circuit 5 does not light a lamp immediately after detecting an adapted lamp but waits until a time set on the timer 104 is over. Accordingly, it is possible to wait the start of lighting a lamp until the mounting work of an adapted lamp in the socket is completely finished and since it is prevented to supply the starting pulse to the lamp after the lamp mounting in the socket, the safety can be enhanced.

Further, when the starting circuit 4 operates, the timer 105 starts the counting and the lamp lighting detector circuit 101 detects the lighting of an adapted lamp and when the adapted lamp does not light until the counting time is over, a signal is output to the controlling circuit 103 and a drive stopping signal is output to the starting circuit 4. Accordingly, even when an adapted lamp becomes defective and does not light, the output of useless pulse is prevented and the dielectric breakdown of the base of a lamp mounted in the socket and adverse effects to other electric/electronic equipment will never be caused.

When a lamp did not light within the counting time by the timer 105 and thereafter, a mounted lamp was exchanged, the lamp mounting detector circuit 5 judges again whether the exchanged lamp is an adapted lamp and if it is an adapted lamp, after the waiting time of the timer 104, the controlling circuit 103 outputs a signal to the driving circuit 92 and the automatic lighting is tried as in the above.

Further, when the adapted lamp 6 lights and after a while, the lamp temperature rises, the power to the detecting element 42 is turned off by the thermally- actuated element 106 and thus, the power loss by the detecting element 42 is prevented.

What is claimed is:

1. A lighting apparatus comprising:

a high pressure discharge lamp including an outer bulb, an arc tube being suspended in the outer bulb, a base being mounted on the outer bulb for detachably coupling to a socket, and an indicating element (i) located outside the arc tube and within the outer bulb, (ii) connected in parallel with the arc tube, and (iii) having a predetermined electrical characteristic for indicating a type of the high pressure discharge lamp;

a first power supply circuit electrically connected to the socket and configured for supplying a first level power to the indicating element for judging the electrical characteristic, the first level power being indicative of the electrical characteristic;

a detecting circuit (i) electrically connected to the first power supply, (ii) being responsive to the first level power, and (iii) configured to discriminate the electrical characteristic of the indicating element prior to the arc tube being illuminated; and a second power supply circuit electrically connected to the socket and configured for supplying a second level power to the high pressure discharge lamp according to an output from the detecting circuit, wherein the second level power illuminates the arc tube.

2. A lighting apparatus according to claim 1, wherein the indicating element is connected to a discharge path electrically in parallel.

3. A lighting apparatus according to claim 1, further comprising:

a starting circuit configured to start the discharge lamp according to the output from the detecting circuit;

wherein the second power supply circuit stably illuminates the arc tube.

4. A lighting apparatus according to claim 3, wherein:

said detecting circuit comprises a judging circuit configured to judge the discharge lamp to be an adapted lamp when the output of the detecting circuit is within a specified range; and said apparatus further comprises a controlling circuit configured to operate the starting circuit and the second power supply circuit when the discharge lamp is judged to be an adapted lamp.

5. A lighting apparatus according to claim 4, further comprising:

a controlling circuit configured to control the outputs of the starting circuit and the second power supply circuit according to he output of the detecting circuit.

6. A lighting apparatus according to claim 4, further comprising:

a timer configured to count a preset time after the judging circuit judged a mounted lamp to be an adapted lamp; and a deactivating circuit configured to keep the starting circuit stopped during the counting by the timer.

7. A lighting apparatus according to claim 6, wherein the starting circuit includes means for applying a starting pulse to the discharge lamp.

8. A lighting apparatus according to claim 3, further comprising:

a timer configured to count a continuous time for generating starting pulses when the starting circuit generates the starting pulses; and a deactivating circuit configured to stop the starting circuit when the time counted by the timer exceeds a preset time.

9. A lighting apparatus according to one of claims 1 to 8, wherein the indicating element has resistance or impedance value larger than a resistance or impedance value of the arc tube when the arc tube is lighted.

10. A lighting apparatus according to one of claims 1 to 8, further comprising:

a thermally-actuated element which is provided in the discharge lamp and is actuated according to the temperature rise when the discharge lamp is ON and turns off the power supplied to the indicating element.

11. A lighting apparatus according to one of claims 1 to 8, wherein the indicating element has a resistance value of temperature coefficient of resistance more than 500 ppm/° C.

12. A lighting apparatus according to claim 1, wherein said detecting circuit is operative to prevent lighting circuit from lighting the discharge lamp when the electrical characteristic of the detecting element is outside of a predetermined range.

* * * * *